US010954691B2

(12) United States Patent
MacKarvich

(10) Patent No.: US 10,954,691 B2
(45) Date of Patent: Mar. 23, 2021

(54) GUARDRAIL BASE AND SYSTEM

(71) Applicant: Charles J. MacKarvich, Atlanta, GA (US)

(72) Inventor: Charles J. MacKarvich, Atlanta, GA (US)

( * ) Notice: Subject to any disclaimer, the term of this patent is extended or adjusted under 35 U.S.C. 154(b) by 446 days.

(21) Appl. No.: 15/901,407

(22) Filed: Feb. 21, 2018

(65) Prior Publication Data

US 2019/0257112 A1 Aug. 22, 2019

(51) Int. Cl.
*E04H 17/22* (2006.01)
*E04G 21/32* (2006.01)

(52) U.S. Cl.
CPC ..... *E04H 17/22* (2013.01); *E04G 21/3223* (2013.01)

(58) Field of Classification Search
CPC ..... E04F 11/1812; E04F 11/1865; E04G 21/3223; E04G 21/3228; E04G 21/3238; E04G 21/3242; E04G 21/3233; E04H 17/22; F16B 7/0433; F16B 9/052; F16B 9/058; Y10T 403/32426; Y10T 403/32557; Y10T 403/32581; Y10T 403/32591; Y10T 403/341; Y10T 403/345; Y10T 403/346; Y10T 403/348; Y10T 403/349; Y10T 403/39; Y10T 403/3906; Y10T 403/4628; Y10T 403/32147; Y10T 403/32155; Y10T 403/32229
USPC ..... 403/104, 113, 116, 117, 170, 174, 175, 403/177, 178, 187, 188, 240, 70, 71, 80; 256/65.14, DIG. 2; 248/176.3, 514
See application file for complete search history.

(56) References Cited

U.S. PATENT DOCUMENTS 716,077 A * 12/1902 Morrin ..... F16B 21/088 403/71
1,030,383 A * 6/1912 Buschman ..... A46B 11/0013 403/71
1,132,658 A * 3/1915 Harrison ..... A47L 13/252 403/70
1,477,685 A * 12/1923 Bostwick ..... B25G 3/38 15/146
1,760,955 A * 6/1930 Moss ..... E04B 1/585 403/174
1,775,558 A * 9/1930 Jayne ..... B25G 1/06 403/71
2,641,513 A * 6/1953 Fryda ..... B25G 3/38 403/71

(Continued)

FOREIGN PATENT DOCUMENTS

EP 1300518 A1 * 4/2003 ..... E04G 21/3233
WO WO-2008037023 A1 * 4/2008 ..... F16B 7/0433

OTHER PUBLICATIONS

MacKarvich, Charles J.; Issue Notification for U.S. Appl. No. 29/616,098, filed Sep. 1, 2017, dated Oct. 3, 2018, 1 pg.

(Continued)

*Primary Examiner* — Josh Skroupa
(74) *Attorney, Agent, or Firm* — Taylor English Duma LLP

(57) ABSTRACT

A guardrail base can include a base body, which can include a first foot, a second foot, and a raised portion between the first foot and the second foot; and a rail mount mounted on the raised portion of the base, the rail mount configured to angularly pivot about and between a first position towards the first foot and a second position towards the second foot.

34 Claims, 13 Drawing Sheets

(56) References Cited

U.S. PATENT DOCUMENTS 3,150,891 A * 9/1964 Eivind ..... F16B 1/00 403/71
3,204,898 A * 9/1965 Manning ..... E04F 11/1812 403/90
3,285,576 A * 11/1966 Clark ..... E04H 17/1413 256/21
4,037,788 A * 7/1977 Riley ..... E04H 17/1413 403/177
5,328,287 A * 7/1994 Gilb ..... E04B 1/26 403/170
5,372,447 A * 12/1994 Chung ..... E04B 1/5831 403/177
D520,649 S 5/2006 Hansort
D521,159 S 5/2006 Hansort
7,232,098 B2 * 6/2007 Rawlings ..... F16M 11/041 248/121
RE39,842 E * 9/2007 Purvis ..... E04H 17/1413 256/59
D554,474 S 11/2007 Miller
D556,015 S 11/2007 Muchnik
7,338,033 B2 3/2008 Anson et al.
D599,915 S 9/2009 Godwin
8,925,904 B2 * 1/2015 Christoffer ..... E04H 17/22 256/65.14
D732,374 S 6/2015 Herbertsson
D732,932 S 6/2015 Ng et al.
D752,954 S 4/2016 Lax et al.
D757,520 S 5/2016 Pratt
D758,609 S 6/2016 Schindler et al.
D767,167 S 9/2016 Masuda et al.
D810,965 S 2/2018 Whiteley
D813,647 S 3/2018 Burmeister-Brown et al.
D822,650 S 7/2018 Kanter
D823,286 S 7/2018 Kanter
D823,093 S 10/2018 Kanter
D830,812 S 10/2018 Kanter
D831,860 S 10/2018 MacKarvich
D833,851 S 11/2018 Kanter
10,294,674 B2 * 5/2019 Guo ..... E04F 11/1812
D882,830 S 4/2020 MacKarvich
2005/0056741 A1 3/2005 Higgs et al.
2015/0041744 A1 2/2015 Higgs
2017/0152674 A1 6/2017 MacKarvich
2017/0363124 A1 * 12/2017 Brown ..... F16B 7/0433
2018/0155939 A1 * 6/2018 Aldridge ..... F16B 7/0433

OTHER PUBLICATIONS

MacKarvich, Charles J.; Notice of Allowance for U.S. Appl. No. 29/663,351, filed Sep. 14, 2018, dated Dec. 27, 2019, 9 pgs.
MacKarvich, Charles J.; Notice of Allowance for U.S. Appl. No. 29/616,098, filed Sep. 1, 2017, dated Jun. 28, 2018, 12 pgs.
MacKarvich, Charles J.; Ex Parte Quayle Action for U.S. Appl. No. 29/663,351, filed Sep. 14, 2018, dated Oct. 1, 2019, 15 pgs.
Mackarvich, Charles J.; Requirement for Restriction/Election for U.S. Appl. No. 17/097,927, filed Nov. 13, 2020, dated Jan. 5, 2021, 6 pgs.

* cited by examiner

GUARDRAIL BASE AND SYSTEM

TECHNICAL FIELD

This disclosure relates to a guardrail base. More specifically, this disclosures relates to an adjustable guardrail base for use on elevated surfaces to provide a secure mount for a vertical post.

BACKGROUND

When working on an elevated surface, such as a roof, it can be desirable or required to have a guardrail positioned around at least a portion of the perimeter of the elevated surface to prevent accidental falls. However, most roofs are inclined and many roofs that are relatively level, such as commercial buildings, can be uneven in portions of the roof, so a flat base positioned on the inclined or uneven roof will have posts extending upward from the base at an acute angle relative to the base and the inclined surface. The angled posts can cause the guardrail to be lower than desired. Further, the angle of the post can cause the guardrail to be in an undesired position relative to the base, making it easier for the guardrail to fail and tip when a load is placed on it, such as a worker gripping or leaning on the guardrails during work on the roof.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a guardrail base comprising a base body comprising a first foot, a second foot, and a raised portion between the first foot and the second foot; and a rail mount mounted on the raised portion of the base, the rail mount configured to angularly pivot about and between a first position towards the first foot and a second position towards the second foot.

Also disclosed is a guardrail system comprising a guardrail base comprising a base body and a rail mount, the rail mount configured to angularly pivot about and between a first position towards a first end of the base body and a second position towards a second end of the base body distal from the first end; and a guardrail comprising a vertical post, the vertical post attached to the rail mount.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
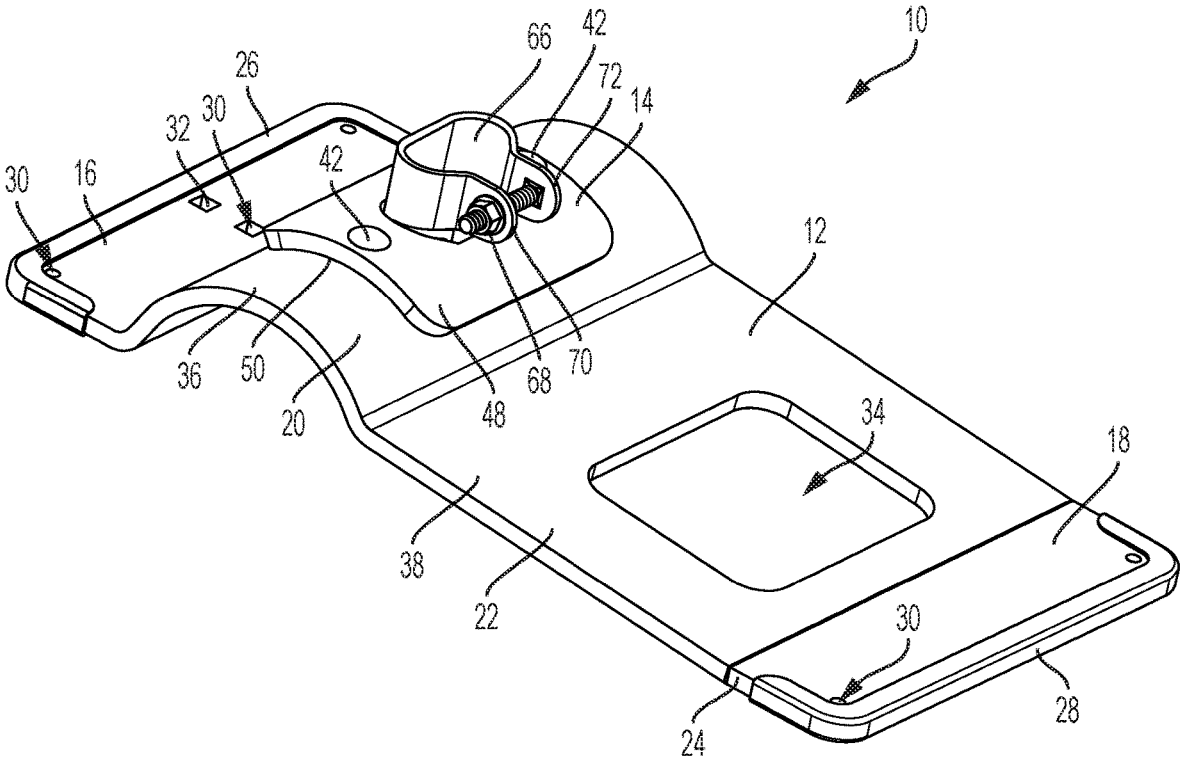
FIG. 1 is a perspective view of a guardrail base comprising a base body and a rail mount rotatably coupled to the base, according to one aspect.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is an adjustable guardrail base, and associated methods, devices, and various apparatus. The adjustable guardrail base can be selectively attachable to an elevated surface, such as a roof, and a vertical post can be coupled to the guardrail base. It would be understood by one of skill in the art that the disclosed adjustable guardrail base is described in but a few exemplary embodiments among many. No particular terminology or description should be considered limiting on the disclosure or the scope of any claims issuing therefrom.

As illustrated in FIG. 1, the guardrail base 10 can comprise a base body 12 and a rail mount 14 rotatably coupled to the base 10. In one aspect, the base body 12 can comprise a first foot 16, a second foot 18 spaced from the first foot a predetermined distance, and a raised portion 20 positioned between the first foot 16 and the second foot 18. In another aspect, each of the first foot 16 and the second foot 18 can be a substantially planar plate. In this aspect, at least a portion of the planar first foot 16 can be substantially parallel to or even coplanar with the planar second foot 18 (illustrated in FIG. 4). In a further aspect, the base body 12 can comprise an upper surface 22 and a lower surface 24 spaced from the upper surface 22 by a thickness of the base body 12.

In some aspects, the guardrail base 10 can further comprise a first foot cover 26 configured to cover at least a portion of the first foot 16, and a second foot cover 28 configured to cover at least a portion of the second foot. In one aspect, the first foot cover 26 and the second foot cover 28 can be formed from an impact-resistant and/or slip-resistant material, such as rubber and the like. In use, the first foot cover 26 and the second foot cover 28 can cover at least a portion of the lower surface 24 of the base body 12 to prevent or reduce damage to the base body 12 or to an elevated surface when the base body 12 is positioned on the elevated surface. Further, the first foot cover 26 and the second foot cover 28 can prevent or reduce slipping of the base body 12 relative to the elevated surface.

In one aspect, at least one bore 30 can be defined in the first foot 16 and/or the second foot 18. The bore 30 can extend from the upper surface 22 to the lower surface 24 so that a fastener, such as a screw, bolt, and the like can be inserted through the bore 30. In use, the fastener can extend through the base body 12 and into the elevated surface to securedly attach the base 10 the elevated surface. In one aspect, the bore 30 can be substantially circular in cross-sectional shape. Optionally, however, at least one bore 30 can be rectangular in cross-sectional shape so that a wall 32 of the bore 30 can engage a head of the fastener. In another aspect, at least one cutout 34 can be defined in a portion of the base body 12, such as the first foot 16, the second foot 18, and/or the raised portion 20 to reduce the weight of the base 10 without reducing the strength of the base 10.

Figure 4:
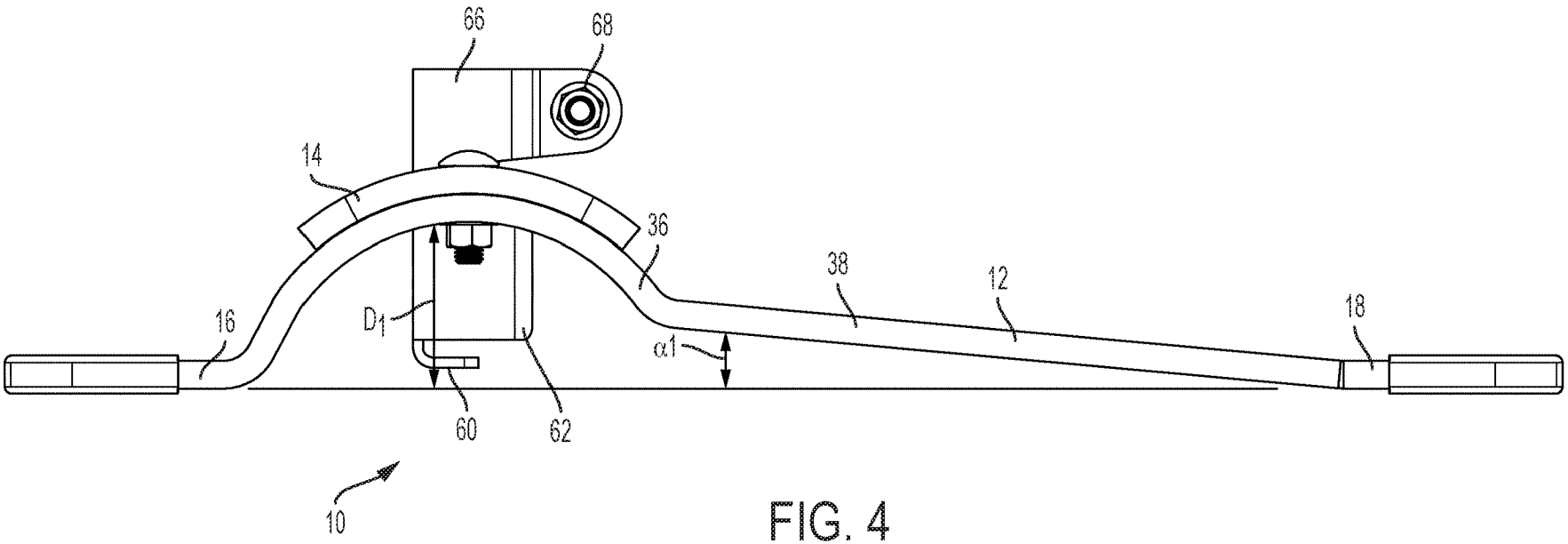
FIG. 4 is a side elevational view of the guardrail base of FIG. 1.

The raised portion 20 of the base body 12 can comprise an arcuate section 36 adjacent to the first foot 16, and a planar section 38 extending from the arcuate section 36 to the second foot 18. In one aspect, the planar section 38 of the raised portion 20 can be at an acute angle $\alpha_1$ relative to the first foot 16 and the second foot 18 (as illustrated in FIG. 4). In another aspect, the arcuate section 36 can have a predetermined radius.

Figure 3:
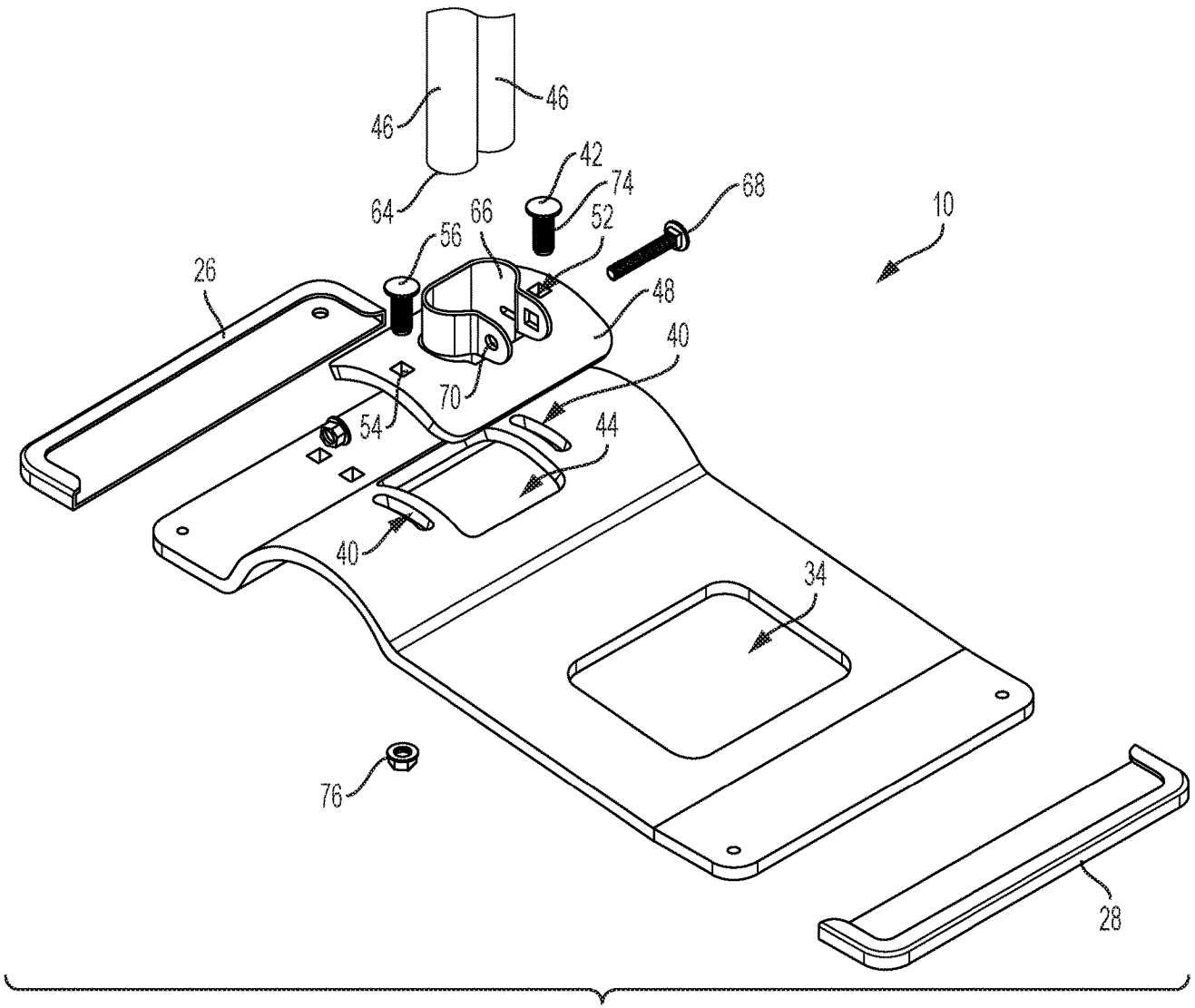
FIG. 3 is an exploded perspective view of the guardrail base of FIG. 1.

With reference now to FIG. 3, at least one slot 40 can be defined in the base body 12 and can extend from the upper surface 22 to the lower surface 24 of the base body 12. In one aspect, the slot 40 can be defined in the raised portion 20 of the base body 12. Optionally, the slot 40 can be defined in the arcuate section 36 of the raised portion 20. The slot 40 can have a slot length and can be configured so that a fastener, such as a bolt 42, can be inserted into the slot 40 such that the fastener can slide relative to the base body 12. In another aspect, the slot 40 can comprise a plurality of slots 40 that are substantially parallel to each other. In the current aspect, two slots 40 and two fasteners 42 are present.

A post aperture 44 can be defined in the base body 12 and can extend from the upper surface 22 to the lower surface 24 of the base body 12. In one aspect, the post aperture 44 can be defined in the raised portion 20 of the base body 12. Optionally, the post aperture 44 can be defined in the arcuate section 36 of the raised portion 20. In another aspect, the post aperture 44 can be positioned between the slots 40. The post aperture 44 can be sized and shaped so that a portion of a vertical post 46 can be inserted through the post aperture 44 of the base body 12. Optionally, the post aperture 44 can be sized and shaped so that a portion of two or more vertical posts 46 can be inserted through the post aperture 44 of the base body 12. The post aperture 44 can also be sized so that the one or more posts 46 can translate within the post aperture 44 as the rail mount 14 translates relative to the base body 12.

Referring again to FIGS. 1 and 3, the rail mount 14 of the base 10 comprises an upper surface 48 and a lower surface 50 spaced from the upper surface 48 by a thickness of the rail mount 14. The rail mount 14 can be selectively, rotatably coupled to the base body 12. In one aspect, the rail mount 14 can be an arcuate plate sized and configured to overlie a portion of the raised portion 20 of the base body 12. In another aspect, the rail mount 14 can be an arcuate plate sized and configured to overlie a portion of the arcuate section 36 of the raised portion 20 of the base body 12. Optionally, the rail mount 14 can be sized and configured to overlie the slot 40 and the post aperture 44 of the base body 12. In yet another aspect, the rail mount 14 can have a predetermined radius that corresponds to the predetermined radius of the arcuate section 36. That is, the rail mount 14 can have a radius that corresponds to the radius of the arcuate section 36 so that, when the rail mount 14 is positioned on the arcuate section 36, the rail mount 14 matingly engages the arcuate section 36. For example, when the rail mount 14 is positioned on the arcuate section 36, the rail mount 14 can slide relative to the arcuate section 36 such that the lower surface 50 of the rail mount 14 is substantially parallel to the upper surface 22 of the base body.

In one aspect, at least one bore 52 can be defined in the rail mount 14 and can extend from the upper surface 48 to the lower surface 50 of the rail mount 14. In another aspect, the bore 52 can be rectangular in cross-sectional shape so that a wall 54 of the bore 52 can engage a head 56 of the bolt 42, such as a bolt, inserted into the bore 52. In another aspect, the bore 52 of the rail mount 14 can be positioned so that, when the rail mount 14 overlies the base body 12, the bore 52 of the rail mount 14 overlies the slot 40 of the base body 12.

Figure 5:
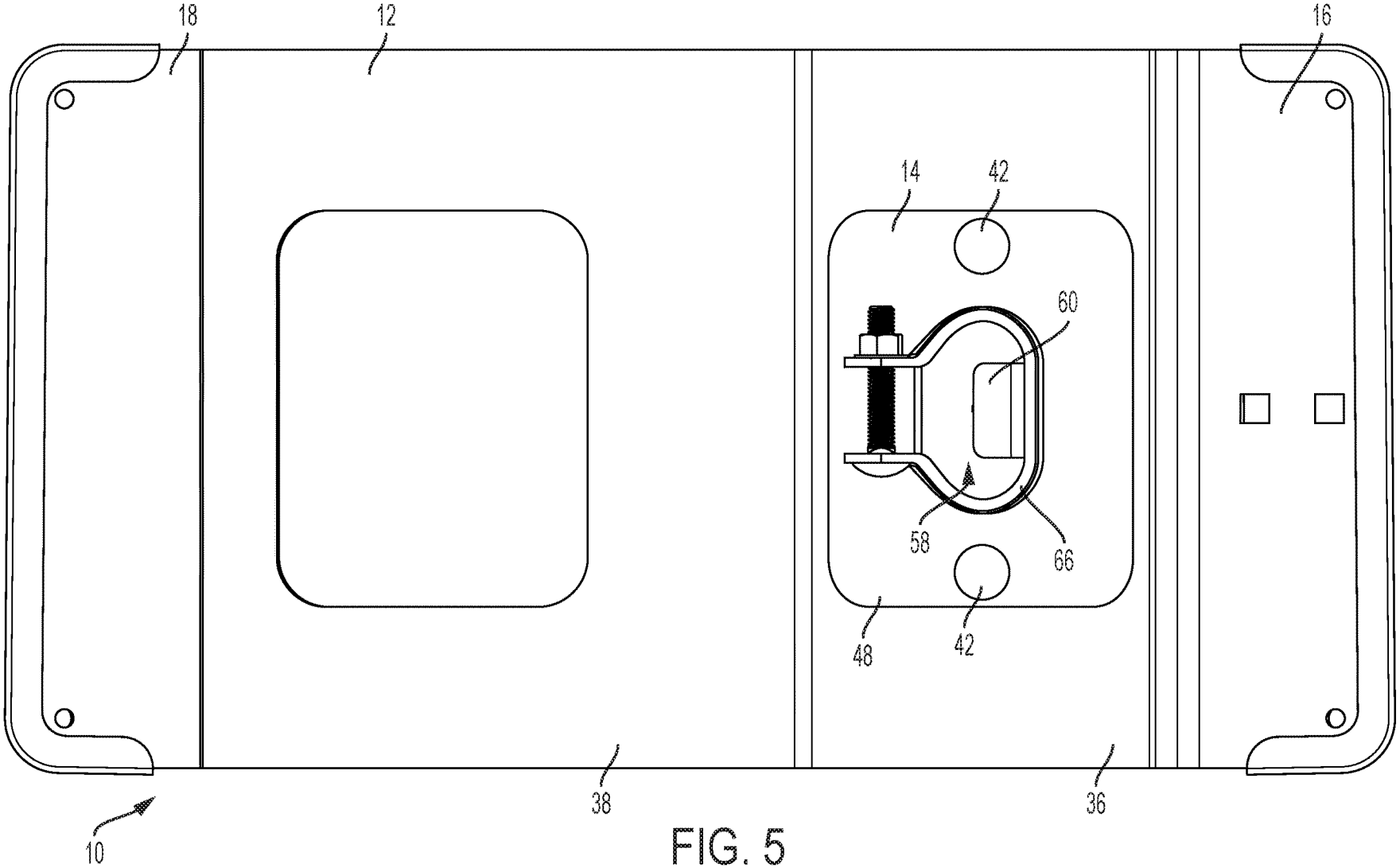
FIG. 5 is a top elevational view of the guardrail base of FIG. 1.

A post hole 58 (illustrated in FIG. 5) can be defined in the rail mount 14 and can extend from the upper surface 48 to the lower surface 50 of the rail mount 14. In one aspect, the post hole 58 can be sized and shaped so that a portion of a vertical post 46 can be inserted through the post hole 58 of the rail mount 14. Optionally, the post hole 58 can be sized and shaped so that a portion of two or more vertical posts 46 can be inserted through the post hole 58. In another aspect, the post hole 58 of the rail mount 14 can be positioned so that, when the rail mount 14 overlies the base body 12, the post hole 58 of the rail mount 14 overlies the post aperture 44 of the base body 12.

Figure 6:
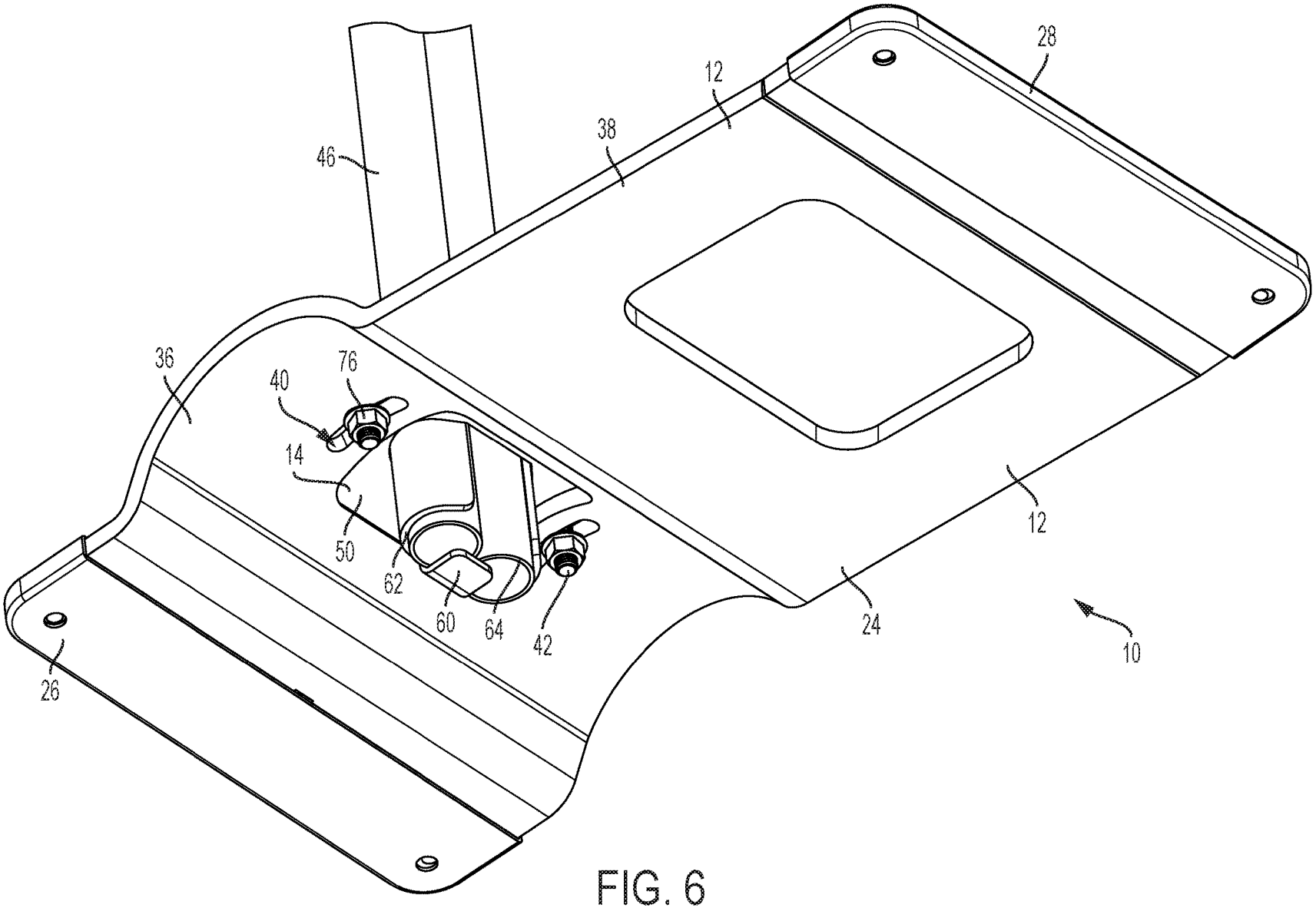
FIG. 6 is a bottom perspective view of the guardrail base of FIG. 1

With reference now to FIG. 6, in one aspect, the rail mount 14 further comprises a catch lip 60 proximate to a bottom end 62 of the post hole 58, the catch lip 60 configured to contact the one or more vertical posts 46 extending through the post hole 58. In this aspect, the catch lip 60 can be a lip spaced from the lower surface 50 of the rail mount 14 a predetermined lip distance. In another aspect, the predetermined lip distance can be less than the radius of the arcuate section 36 of the raised portion 20 of the base body 12. Alternatively, the predetermined lip distance can be less than a vertical distance D1 from the lower surface 24 of the arcuate section 36 to the first foot 16 (as illustrated in FIG. 4). The catch lip 60 can be sized and shaped so that a bottom edge 64 of the vertical post 46, or a plurality of vertical posts 46 extending through the post hole 58, contact and engage the catch lip 60 to prevent the bottom edge 64 of the vertical post 46 from moving away from the rail mount 14 beyond the catch lip 60.

As illustrated in FIG. 1, the rail mount 14 can further comprise a post hole wall 66 and a tightening fastener 68 configured to reduce a cross-sectional area of the post hole 58. In one aspect, the post hole wall 66 can extend around a portion of the perimeter of the post hole 58 and can extend upwards away from the upper surface 48 of the rail mount 14 a predetermined wall distance. The post hole wall 66 can have a cross-sectional shape that corresponds to the cross-sectional shape of at least one vertical post 46. A first end 70 of the post hole wall 66 can be spaced from a second end 72 of the post hole wall 66 such that the tightening fastener 68 can couple the first end 70 to the second end 72. In one aspect, the tightening fastener 68 can be configured to to reduce a cross-sectional area of the post hole 58. That is, rotation of the tightening fastener 68, which is a nut and bolt in the current aspect, can cause the first end 70 of the post hole wall 66 to move towards the second end 72 of the post hole wall 66, thereby reducing the cross-sectional area of the post hole 58.

In one aspect, the guardrail base 10 can further comprise one or more fasteners, such as the bolt 42, configured to fix the rail mount 14 in a set position relative to the raised portion 20 of the base body 12. In another aspect, the fastener is the bolt 42 and a nut 76.

Referring again to FIG. 3, to assemble the guardrail base 10, the first foot cover 26 can be positioned on the first foot 16, and the second foot cover 28 can be positioned on the second foot 18. The rail mount 14 can be positioned over the base body 12 such that the bores 52 of the rail mount 14 overlie the corresponding slots 40 of the base body 12. The bolts 42 can be inserted through the respective bores 52 until the heads 56 of each bolt 42 engage the walls 54 of each bore 52 to prevent rotation of the bolts 42. A shank 74 of each bolt 42 can extend through the corresponding slots 40 of the base body 12. In one aspect, the rail mount 14 can be rotated by a user to a desired position relative to the base body 12. A portion of each bolt 42 can slide within its corresponding slot 40 and each nut 76 can be positioned on the respective shank 74 and tightened to fixedly attach the rail mount 14 to the base body 12 at a set position relative to the raised portion 20 of the base body 12. In one aspect (not shown), the location of the slot 40 and the bore 52 can be reversed. That is, in this aspect, the slot 40 can be defined in the rail mount 14 and the bore 52 can be defined in the base body 12 so that when the rail mount 14 overlies the base body 12, the slot 40 of the rail mount 14 overlies the bore 52 of the base body 12. The bolt 42 can be inserted through the bores 52 of the base body 12 with the shank 74 of each bolt 42 extending through the corresponding slots 40 of the rail mount 14.

Figure 7:
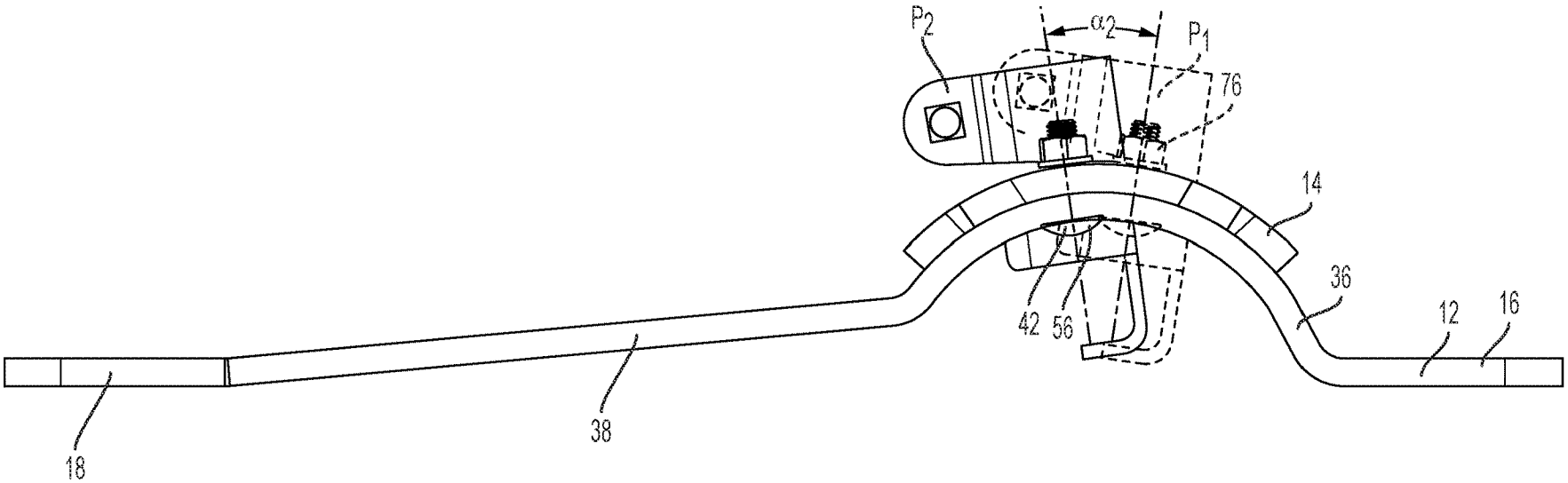
FIG. 7 is a side elevational view of the guardrail base of FIG. 1 showing the rail mount in a plurality of positions relative to the base body.

With reference to FIG. 7, in one aspect, the rail mount 14 can rotate or pivot relative to the base body 12 about and between a first position $P_1$, in which the rail mount 14 is positioned towards the first foot 16, and a second position $P_2$ in which the rail mount 14 is positioned towards the second foot 18. Thus, the bolt 42 that engages the rail mount 14 through the slot 40 and to the base body 12 can slide within the slot 40 from the first position to the second position. In another aspect, the rail mount 14 can be configured to angularly pivot a predetermined angle $\alpha_2$ relative to the base body 12. In a further aspect, the rail mount 14 can be configured to angularly pivot at least 1 degree, at least 2 degrees, at least 4 degrees, at least 5 degrees, at least 6 degrees, at least 8 degrees, at least 10 degrees, at least 12 degrees, at least 14 degrees, at least 16 degrees, at least 18 degrees, at least 20 degrees, or more than 20 degrees relative to the base body 12. As shown in FIG. 7, in some aspects, the bolt 42 can be inserted into the slot 40 and the bore 52 from a bottom side of the base body 12, thereby placing the head 56 in contact with the lower surface 24 of the base body 12 and placing the nut 76 in contact with the upper surface 48 of the rail mount 14.

Figure 2:
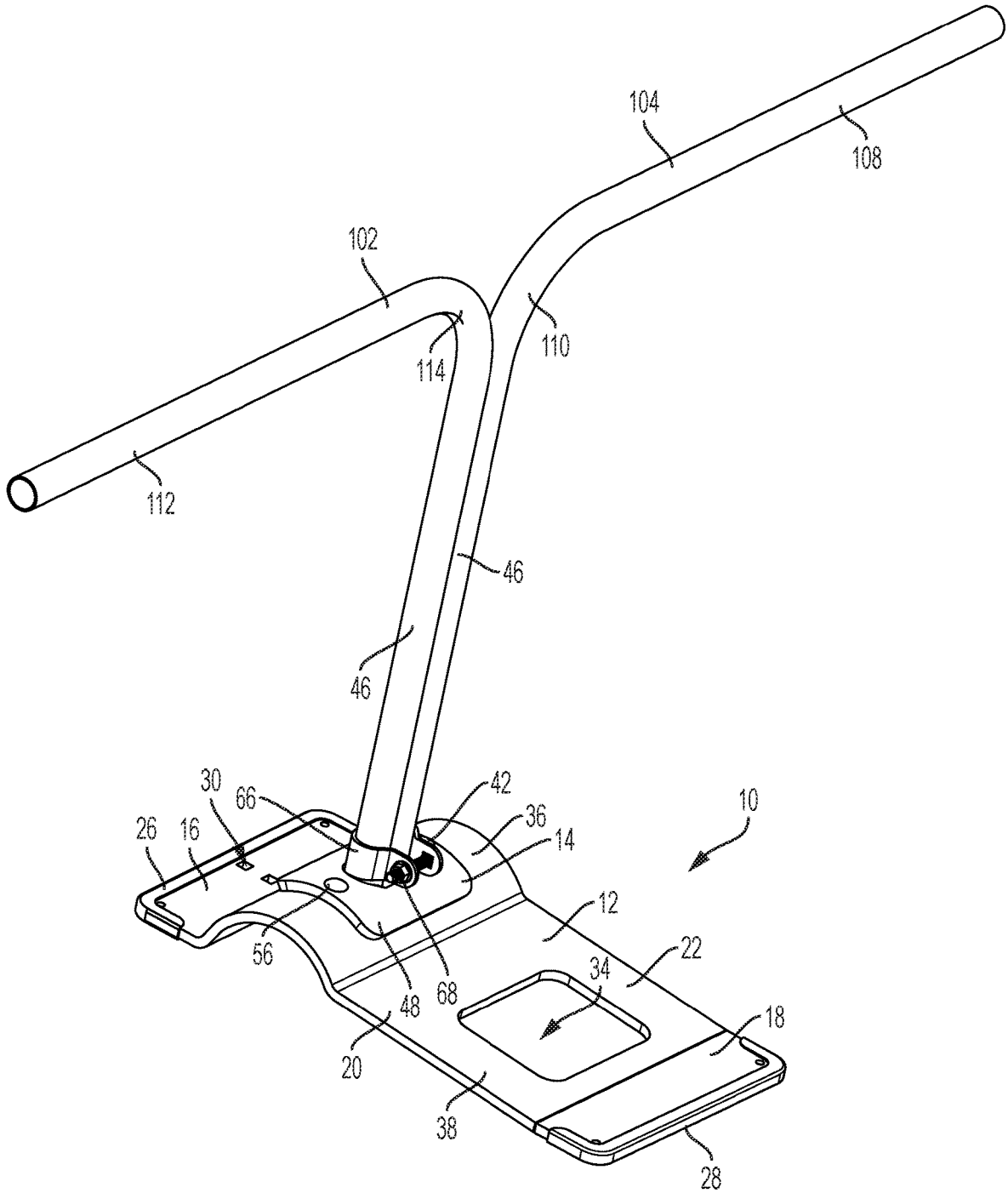
FIG. 2 is a perspective view of a guardrail system comprising the guardrail base of FIG. 1 and a pair of guardrails comprising vertical posts according to one aspect.

The bottom edge 64 of the vertical post 46 can be positioned in the post hole 58 of the rail mount 14 and the post aperture 44 in the base body 12 until the bottom edge 64 contacts the catch lip 60. The tightening fastener 68 can be rotated to cause the first end 70 of the post hole wall 66 to move towards the second end 72 of the post hole wall 66 until the vertical post 46 is securedly attached to the rail mount 14, as illustrated in FIG. 2.

To use the guardrail base 10, the base 10 can be coupled to an elevated surface by inserting a fastener through at least one bore 30 defined in the first foot 16 and/or the second foot 18. In other aspects, the base 10 need not be coupled to the elevated surface and can simply rest on the elevated surface without attachment thereto. The rail mount 14 can be rotated to a desired position relative to the base body 12 and securedly fastened in the desired position. For example, the desired position can be selected so that when a vertical post 46 is coupled to the rail mount 14, the vertical post 46 can be substantially vertical, even if the elevated surface is inclined.

Figure 8:
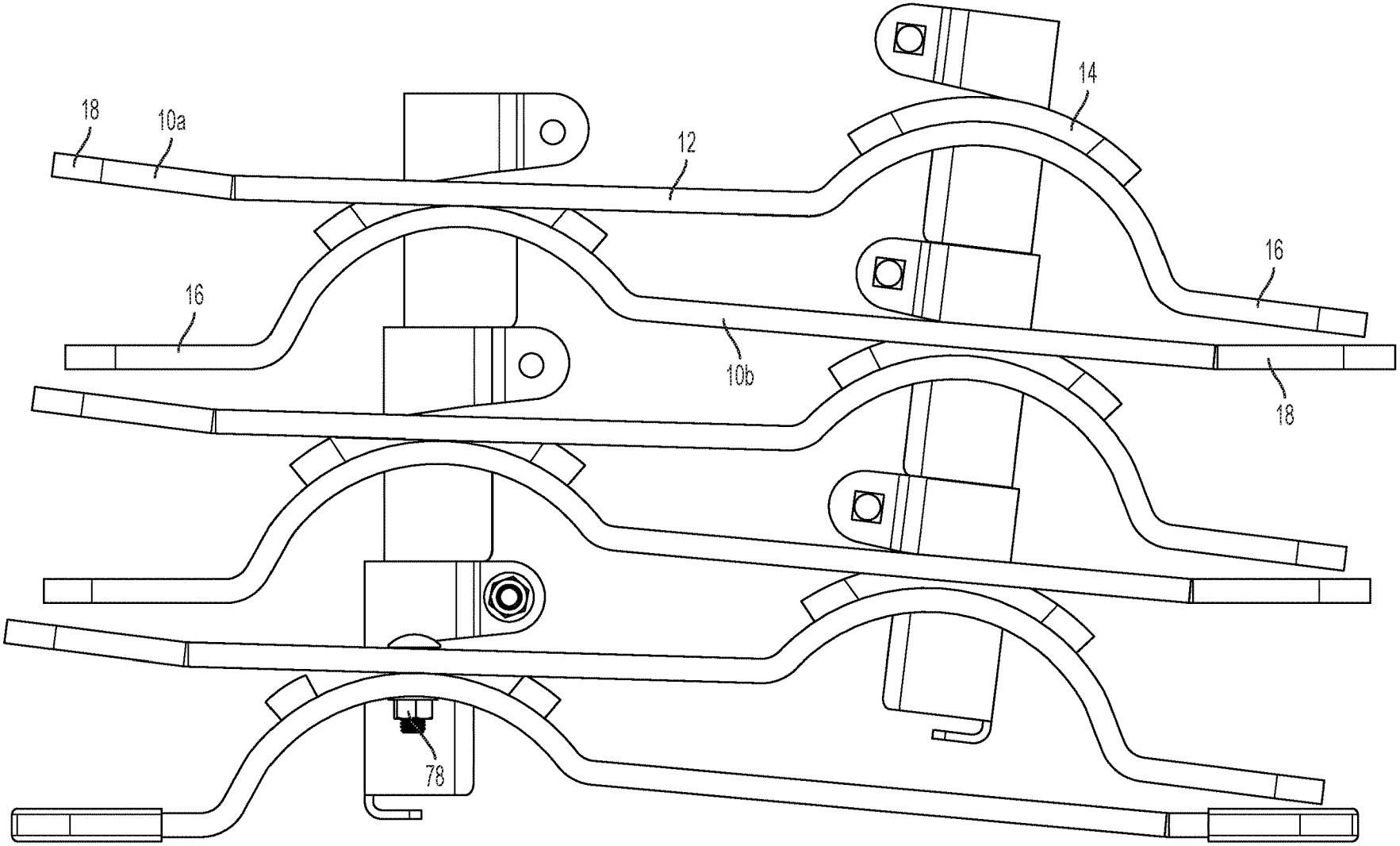
FIG. 8 is a side elevational view of a plurality of guardrail bases of FIG. 1 coupled together, according to one aspect.
Figure 9:
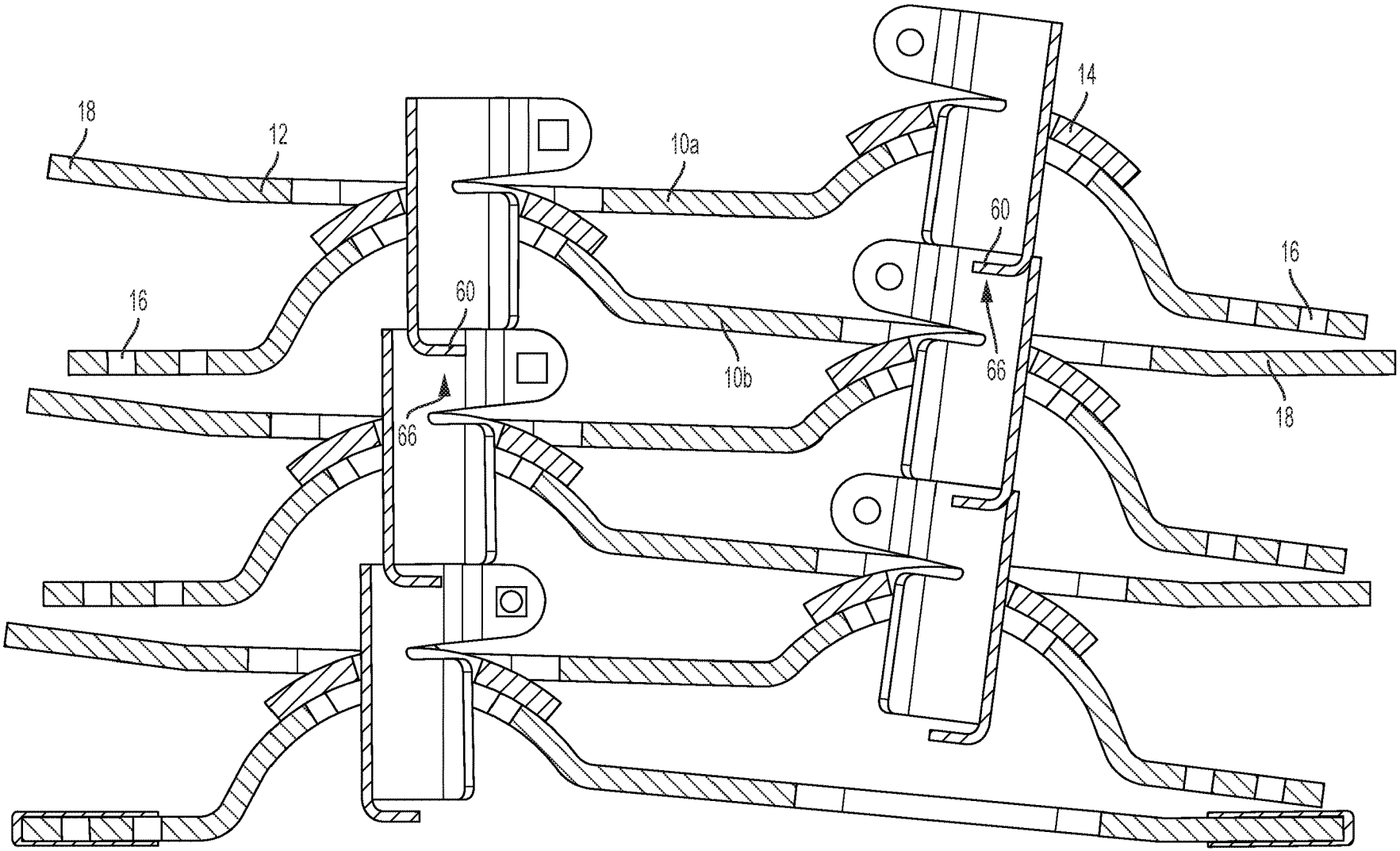
FIG. 9 is a cross-sectional view of the plurality of guardrail bases of FIG. 8.

FIGS. 8 and 9 illustrate one system for transporting a plurality of guardrail bases 10. For example, the plurality of guardrail bases 10 can be stacked vertically such that the first foot 16 of a first guardrail base 10*a* overlies the second foot 18 of a second guardrail base 10*b*, and the second foot 18 of the first guardrail base 10*a* overlies the first foot 16 of the second foot 18 of the second guardrail base 10*b*. When stacked in this manner, the catch lip 60 of the first guardrail base 10*a* can be positioned in the post hole 58 of the second guardrail base 10*b*. A fastener 78, such as a bolt, pin, and the like can be used to secure each guardrail base 10 to an adjacent guardrail base 10.

Also disclosed is a guardrail system, and associated methods, devices, and various apparatus. The guardrail system comprises the adjustable guardrail base 10 and one or more guardrails each comprising a vertical post 46 as described above. It would be understood by one of skill in the art that the disclosed guardrail system is described in but a few exemplary embodiments among many. No particular terminology or description should be considered limiting on the disclosure or the scope of any claims issuing therefrom.

Figure 10:
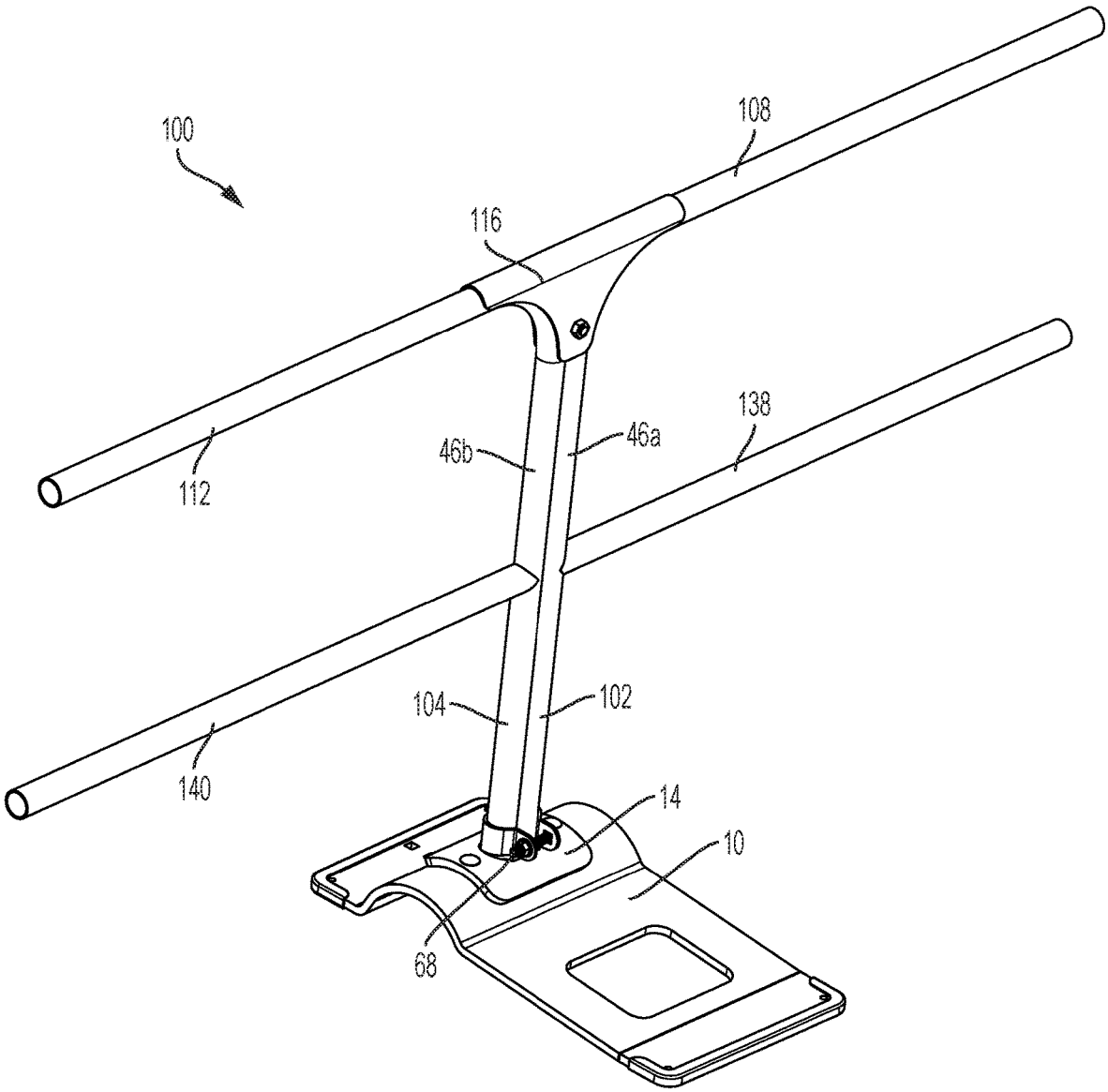
FIG. 10 is a perspective view of another aspect of the guardrail system of FIG. 2.

Referring now to FIG. 10, in one aspect, the guardrail system 100 can comprise the adjustable guardrail base 10 and a first guardrail 102 comprising one of the vertical posts 46 attached to the rail mount 14 of the guardrail base 10, designated as vertical post 46*a*. In one aspect, the the system 100 can further comprise a second guardrail 104 comprising another vertical post 46 attached to the rail mount 14, designated as vertical post 46*b*. In this aspect, the vertical post 46*a* of the first guardrail 102 and the vertical post 46*b* of the second guardrail 104 extend through the post hole 58 defined through the rail mount 14. With the first guardrail 102 and the second guardrail 104 in the desired position in the rail mount 14, the tightening fastener 68 of the rail mount 14 can be tightened against the vertical post 46 of the first guardrail 102 and the vertical post 46 of the second guardrail 104.

Figure 11:
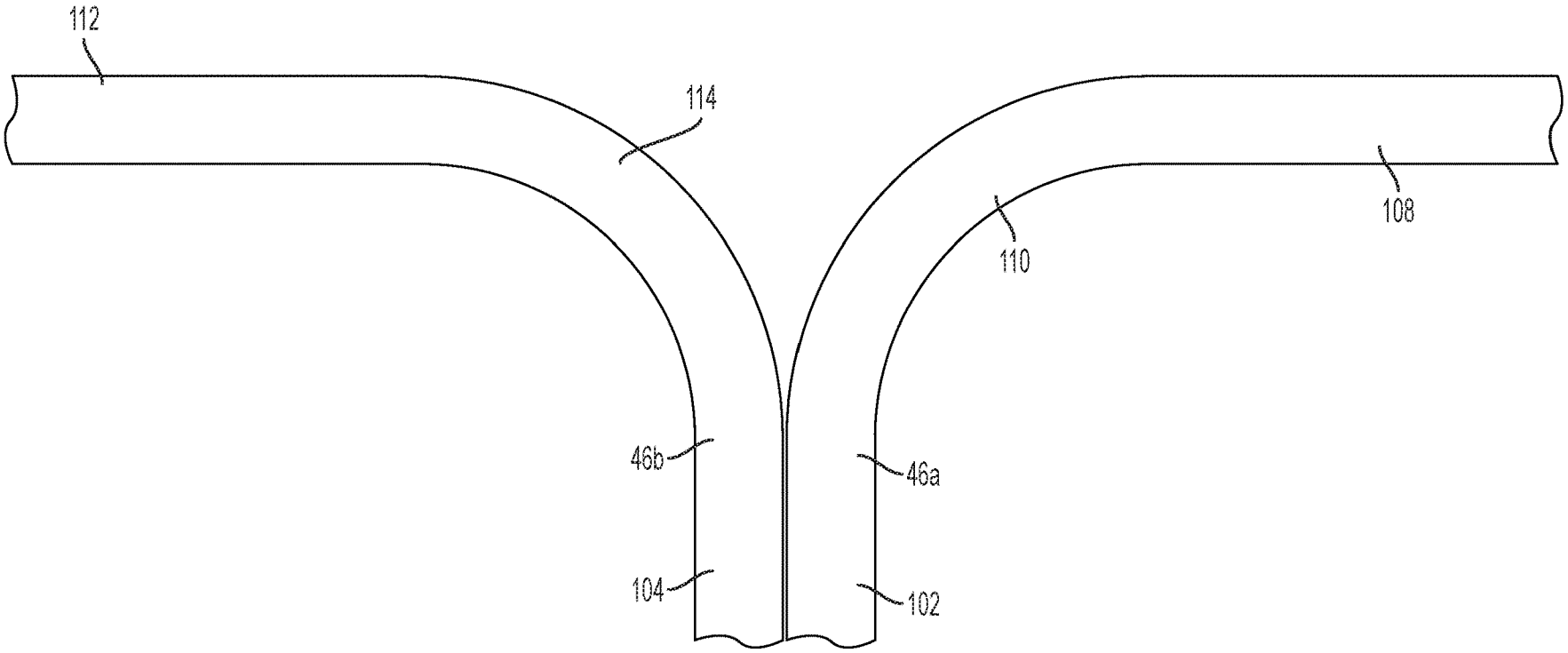
FIG. 11 is a side elevational view of a portion of the guardrails of FIG. 10.

In one aspect and as illustrated in FIG. 11, the first guardrail 102 further comprises a first horizontal post 108 and a first transition post 110 positioned between and extending from the first horizontal post 108 to the first vertical post 46*a*. In another aspect, the first horizontal post 108, the first transition post 110, and the first vertical post 46*a* can be coupled together, either through fasteners, welding, being formed together by bending a tube or pipe, or any other desired method. Similarly, the second guardrail 104 further comprises a second horizontal post 112 and a second transition post 114 positioned between and extending from the second horizontal post 112 to the second vertical post 46*b*. In another aspect, the second horizontal post 112, the second transition post 114 and the second vertical post 46*b* can be coupled together, either through fasteners, welding, being formed together by bending a tube or pipe, or any other desired method. For example, the posts can be permanently coupled together with welds, being formed integrally with each other, and the like. Optionally however, the posts can be removable coupled together with a pressure fit, a protruding prong, and the like. In a further aspect, at least a portion of the first transition post 110 and the second transition post 114 can be arcuate in shape. In one aspect, the posts of the guardrail system 100 can be formed from elongate tubular steel, elongate tubular aluminum, plastics and the like, and can be formed with fabrication methods such as extrusion, casting, and the like.

Additionally, as shown in FIG. 10, the first guardrail 102 can comprise a lower horizontal post 138 and the second guardrail 104 can comprise a lower horizontal post 140. Each lower horizontal post 138,140 can be constructed similar to the posts described above. In some aspects, the lower horizontal posts 138,140 can be welded or otherwise coupled to the respective vertical posts 46*a,b*. The lower horizontal posts 138,140 can provide additional safety to prevent workers from falling underneath the horizontal posts 108,112.

Figure 12:
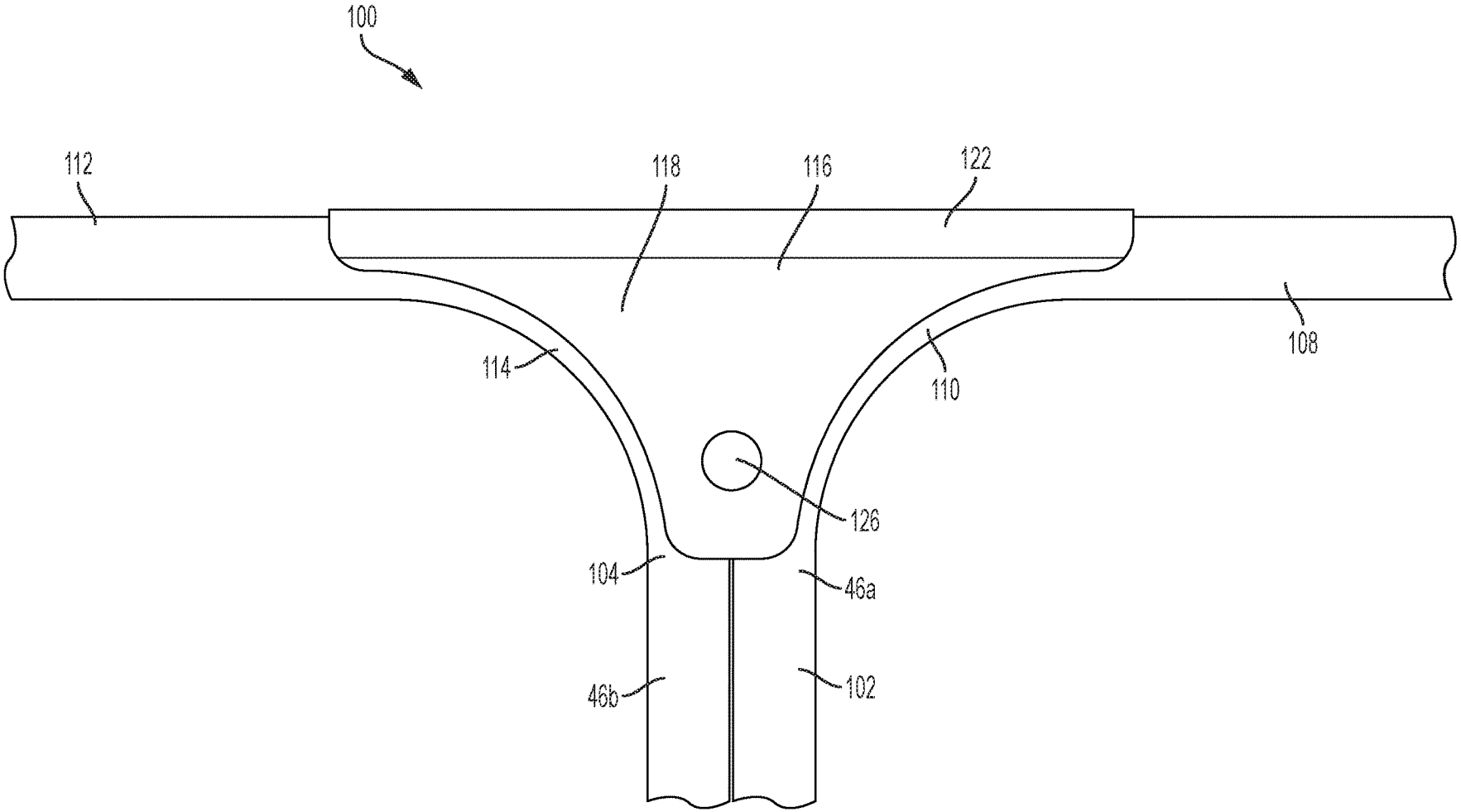
FIG. 12 is a side elevational view of the portion of the guardrails of FIG. 11 with a rail bracket installed, according to one aspect.
Figure 13:
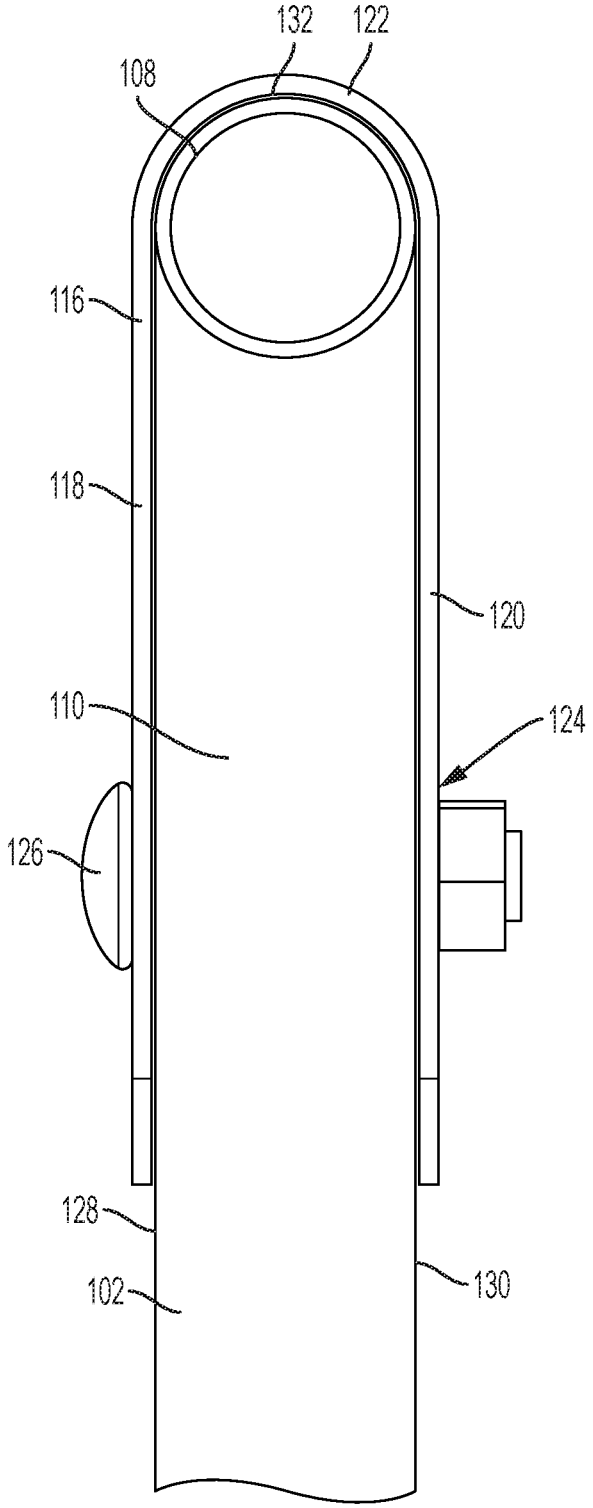
FIG. 13 is a cross-sectional view of the portion of the guardrail of FIG. 11 showing a side view of the bracket of FIG. 12.

With reference now to FIGS. 12 and 13, in another aspect, the guardrail system 100 further comprises a rail bracket 116 configured for attaching the first transition post 110 of the first guardrail 102 to the second transition post 114 of the second guardrail 104. In this aspect, the rail bracket 116 can comprise a first plate 118, a second plate 120 (shown in FIG. 13) spaced from and substantially parallel to the first plate 118, and a connecting member 122 positioned between the first plate 118 and the second plate 120. At least a portion of the connecting member 122 can be arcuate in shape to substantially conform to the shape of the posts. That is, with the rail bracket 116 in place on the first transition post 110 of the first guardrail 102 and the second transition post 114 of the second guardrail 104, the rail bracket 116 can cover at least a portion of a front side 128, a back side 130, and a top side 132 of each of the first guardrail 102 and the second guardrail 104. Optionally, in another aspect, the rail bracket 116 can cover at least a portion of the first transition post 110 of the first guardrail 102 and the second transition post 114 of the second guardrail 104. In yet another aspect, the rail bracket 116 can be substantially T-shaped, with a vertical central portion and a horiztonal portion extending on each side at a top of the vertical portion.

An aperture 124 can extend through the first plate 118 and the second plate 120 for a fastener 126, such as a nut and bolt, pin, and the like. In one aspect, the fastener 126 can securedly couple the rail bracket 116 to the first transition post 110 and the second transition post 114. That is, the fastener 126 of the rail bracket 116 can be configured to grip the rail bracket 116 against the first guardrail 102 and the second guardrail 104 by pulling the first plate 118 towards the second plate 120 and pinning the first guardrail 102 and the second guardrail 104 therebetween. In another aspect, the fastener 126 can extend in a space defined between the first transition post 110 of the first guardrail 102 and the second transition 114 post of the second guardrail 104. The rail bracket 116 can be configured to help maintain the first and second vertical posts 46*a,b*, the first and second transition posts 110,114, and the first and second horizontal posts 108,112 in the desired positions and orientations, and can distribute any load from the first guardrail 102 to the adjacent second guardrail 104, and vice-versa. This is especially beneficial for horizontal loads, such as workers leaning or falling on either of the horizontal posts 108,112, thereby giving support from adjacent guardrails to the loaded guardrail.

To install the guardrail system 100, the adjustable guardrail base 10 can be coupled to an elevated surface by inserting a fastener through at least one bore 30 defined in the first foot 16 and/or the second foot 18, or the guardrail base 10 can simply be placed directly on the elevated surface without fasteners. The rail mount 14 can be pivoted or rotated to a desired position relative to the base body 12 and securedly fastened in the desired position. For example, the desired position can be selected so that when a guardrail 102,104, such as the vertical post 46*a,b*, is coupled to the rail mount 14, the vertical post 46*a,b* can be substantially vertical, even if the elevated surface is inclined or uneven. The guardrails 102,104 can be mounted on the rail mount 14. This can be done by inserting the vertical posts 46*a,b* into the post hole 58 defined through the rail mount 14 until the vertical posts 46*a,b* contact the catch lip 60. The rail mount 14 can be rotated to the desired position either before or after inserting the vertical posts 46*a,b*. With the vertical posts 46*a,b* in the desired position in the rail mount 14, the tightening fastener 68 of the rail mount 14 can be tightened against the vertical posts 46*a* of the first guardrail 102 and the vertical post 46*b* of the second guardrail 104. The first transition post 110 can be coupled to the first vertical post 46*a*, and the first horizontal post 108 can be coupled to the first transition post 110. The second transition post 114 can be coupled to the second vertical post 46*b*, and the second horizontal post 112 can be coupled to the second transition post 114. The rail bracket 116 can be positioned on the first transition post 110 of the first guardrail 102 and the second transition post 114 of the second guardrail 104 and securedly fastened in place.

The process can be repeated around at least a portion of the elevated surface, such as all or a portion of a perimeter of the elevated surface. For example, a second guardrail base 10 can be spaced from the first guardrail base 10 on the elevated surface a predetermined distance, and at least one horizontal post 108,112 can extend between the vertical posts 46 of each guardrail base 10. In this manner, the entire perimeter of an elevated surface can be enclosed by the guardrail system 100. Optionally, just a portion, for example, one side, of the elevated surface can have a guardrail system 100.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A guardrail base comprising:

a base body comprising a first foot, a second foot, and a raised portion between the first foot and the second foot, the base body configured to be placed on an elevated surface without fasteners attaching the base body to the elevated surface; and a rail mount comprising an arcuate plate and mounted on the raised portion of the base, the rail mount configured to angularly pivot about and between a first position towards the first foot and a second position towards the second foot while maintaining a position of the guardrail base.

2. The guardrail base of claim 1, wherein the rail mount defines a post hole therethrough.

3. The guardrail base of claim 2, wherein the rail mount defines a catch lip proximate to a bottom end of the post hole, the catch lip configured to contact a rail post extending through the post hole.

4. The guardrail base of claim 2, wherein the post hole is sized to accept at least two rail posts.

5. The guardrail base of claim 2, wherein the rail mount comprises a tightening fastener configured to reduce a cross-sectional area of the post hole.

6. The guardrail base of claim 1, wherein the raised portion defines a slot and the rail mount is engaged to the slot.

7. The guardrail base of claim 6, further comprising a bolt engaging the rail mount to the slot, the bolt configured to slide within the slot from the first position to the second position.

8. The guardrail base of claim 7, wherein the bolt extends through the rail mount and the slot in the raised portion.

9. The guardrail base of claim 7, further comprising a nut, wherein:

the bolt defines a head and a shank, the head engages the rail mount and the nut engages the shank, and the nut is configured to tighten against the raised portion to fix the rail mount in a set position relative to the raised portion.

10. The guardrail base of claim 1, further comprising a fastener configured to fix the rail mount in a set position relative to the raised portion.

11. The guardrail base of claim 10, wherein the fastener comprises a nut and a bolt.

12. The guardrail base of claim 1, wherein the raised portion comprises an arcuate section and the rail mount is mounted on the arcuate section.

13. The guardrail base of claim 12, wherein the raised portion further comprises a planar section extending from the arcuate section to the second foot.

14. The guardrail base of claim 1, further comprising a first rubber foot cover and a second rubber foot cover, wherein the first rubber foot cover covers the first foot and the second rubber foot cover covers the second foot.

15. The guardrail base of claim 1, wherein the rail mount is configured to angularly pivot at least 1 degree.

16. The guardrail base of claim 1, wherein the rail mount is configured to angularly pivot at least 10 degrees.

17. The guardrail system of claim 1, wherein the rail mount further comprises a post hole wall extending upwards from an upper surface of the arcuate plate of the rail mount.

18. A guardrail system comprising:

a guardrail base comprising a base body and a rail mount, the base body configured to be placed on an elevated surface without fasteners attaching the guardrail base to the elevated surface; and a guardrail comprising a vertical post, the vertical post attached to the rail mount, the rail mount configured to angularly pivot about and between a first position towards a first end of the base body and a second position towards a second end of the base body distal from the first end and also support the guardrail while maintaining a position of the guardrail base.

19. The guardrail system of claim 18, wherein the guardrail is a first guardrail and wherein the system further comprises a second guardrail comprising a vertical post attached to the rail mount.

20. The guardrail system of claim 19, wherein the vertical post of the first guardrail and the vertical post of the second guard rail both extend through a post hole defined through the rail mount, and wherein the rail mount comprises a tightening fastener configured to tighten the rail mount against the vertical post of the first guardrail and the vertical post of the second guardrail.

21. The guardrail system of claim 19, wherein the first guardrail and the second guardrail each comprise a horizontal post and a transition post extending from the horizontal post to the vertical post, and wherein the system further comprises a rail bracket attaching the transition post of the first guardrail to the transition post of the second guardrail.

22. The guardrail system of claim 21, wherein the transition post of the first guardrail and the transition post of the second guardrail are arcuate.

23. The guardrail system of claim 21, wherein the rail bracket covers a front side, a back side, and a top side of each of the first guardrail and the second guardrail.

24. The guardrail system of claim 21, wherein the rail bracket covers the transition post of the first guardrail and the transition post of the second guardrail.

25. The guardrail system of claim 21, wherein the rail bracket is T-shaped.

26. The guardrail system of claim 21, wherein the rail bracket comprises a fastener configured to grip the rail bracket against the first guardrail and the second guardrail.

27. The guardrail system of claim 26, wherein the fastener extends between the transition post of the first guardrail and the transition post of the second guardrail.

28. The guardrail system of claim 18, wherein the guardrail is a first guardrail, the guardrail system further comprising a rail bracket joining the first guardrail to a second guardrail, the rail bracket comprising a plate.

29. The guardrail system of claim 18, wherein the guardrail is a first guardrail, the first guardrail further comprising a vertical post, a horizontal post, and a transition post extending from the horizontal post to the vertical post, the guardrail system further comprising a second guardrail, the second guardrail comprising a vertical post, a horizontal post, and a transition post extending from the horizontal post of the second guardrail to the vertical post of the second guardrail, the vertical post of the second guardrail attached to the rail mount, the guardrail system further comprising a rail bracket extending from the transition post of the first guardrail to the transition post of the second guardrail, the rail bracket receiving at least a portion of each of the transition post of the first guardrail and the transition post of the second guardrail, the rail bracket thereby joining the first guardrail to the second guardrail.

30. A method of installing a guardrail system, the method comprising:

placing a guardrail base on an elevated surface without fasteners attaching the guardrail base to the elevated surface, the guardrail base comprising a base body comprising a first foot, a second foot, and a raised portion between the first foot and the second foot, and a rail mount mounted on the raised portion of the base, the rail mount configured to angularly pivot about and between a first position towards the first foot and a second position towards the second foot;

mounting a guardrail on the rail mount; and pivoting the rail mount and the guardrail relative to the base body to place the guardrail into a desired position without overturning the guardrail system.

31. The method of claim 30, wherein the elevated surface is uneven and wherein the desired position comprises a vertical post of the guardrail in a vertical orientation.

32. The method of claim 30, wherein mounting the guardrail on the rail mount comprises inserting a vertical post of the guardrail into a post hole defined through the rail mount until the vertical post contacts a catch lip of the rail mount.

33. The method of claim 30, wherein the guardrail is a first guardrail, the method further comprising:

mounting a second guardrail on the rail mount; and attaching a first transition post of the first guardrail to a second transition post of the second guardrail with a rail bracket.

34. A guardrail system comprising:

a guardrail base comprising a base body and a rail mount, the base body configured to be placed on an elevated surface without fasteners attaching the base body to the elevated surface, the rail mount comprising an arcuate plate and configured to angularly pivot about and between a first position towards a first end of the base body and a second position towards a second end of the base body distal from the first end while maintaining a position of the guardrail base; and a guardrail comprising a vertical post, the vertical post attached to the rail mount.

* * * * *